US007625221B1

(12) United States Patent
Hsieh et al.

(10) Patent No.: US 7,625,221 B1
(45) Date of Patent: Dec. 1, 2009

(54) ELASTIC CONTACT

(75) Inventors: Kun-Chih Hsieh, Taipei Hsien (TW); Jian-Qiang Zhao, Shenzhen (CN); Jin-Sheng Huang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/421,584

(22) Filed: Apr. 9, 2009

(30) Foreign Application Priority Data

Jul. 10, 2008 (CN) ..... 2008 1 0302686

(51) Int. Cl.
*H01R 12/00* (2006.01)

(52) U.S. Cl. ..... 439/81

(58) Field of Classification Search ..... 439/81, 439/66, 862, 842, 884, 835
See application file for complete search history.

(56) References Cited

U.S. PATENT DOCUMENTS 2,499,296 A * 2/1950 Buchanan ..... 439/848
2,787,693 A * 4/1957 Razlag ..... 439/80
3,372,308 A * 3/1968 Sarazen et al. ..... 361/735
3,634,654 A * 1/1972 Peetz et al. ..... 219/522
3,796,986 A * 3/1974 Tamburro ..... 439/329
4,518,138 A * 5/1985 Stutenkemper et al. ..... 248/73
4,692,842 A * 9/1987 Joly et al. ..... 361/679.32
4,699,593 A * 10/1987 Grabbe et al. ..... 439/71
6,948,942 B1 * 9/2005 Chih ..... 439/66
7,115,005 B2 * 10/2006 Zhu et al. ..... 439/862
7,445,461 B1 * 11/2008 Polnyi ..... 439/66
7,556,503 B2 * 7/2009 Vinther ..... 439/66
2002/0086591 A1 * 7/2002 Orihara ..... 439/862

* cited by examiner

*Primary Examiner*—T C Patel
*Assistant Examiner*—Vladimir Imas
(74) *Attorney, Agent, or Firm*—Zhigang Ma

(57) ABSTRACT

An elastic contact includes a first elastic piece and a second elastic piece. The first elastic piece includes a base configured for being soldered to a circuit board and a connection part. The second elastic piece includes a contact part configured for resiliently pressing against an element and a connection part. Two sidewalls of one of the connection part bend to form grooves for receiving the other connection part. Limiting means are formed on either of the connection parts for limiting sliding range of the elastic pieces relative to each other. The first elastic piece of the elastic contact can be soldered to the circuit board by a SMT machine, thus the assembly efficiency is improved.

7 Claims, 4 Drawing Sheets

ELASTIC CONTACT

BACKGROUND

1. Technical Field

The disclosure relates to an elastic contact.

2. Description of Related Art

Elastic contacts are widely used in electronic devices. One end of the elastic contact is soldered to a circuit board of the electronic device, the other end of the elastic contact resiliently presses against an electronic element of the electronic device, thus electrically connecting the circuit board and the electronic element.

Usually, the height of the elastic contact should be roughly the same as the distance between the mounting surface of the circuit board and the top of the electronic element. If the height, however, is more than 10 millimeters, the elastic contact cannot be mounted to the circuit board by a surface mount technology (SMT) machine, and the mounting efficiency will be low.

What is needed is an elastic contact, which can be mounted to a circuit board by an SMT machine regardless the height of the elastic contact.

BRIEF DESCRIPTION OF THE DRAWINGS

The elements in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
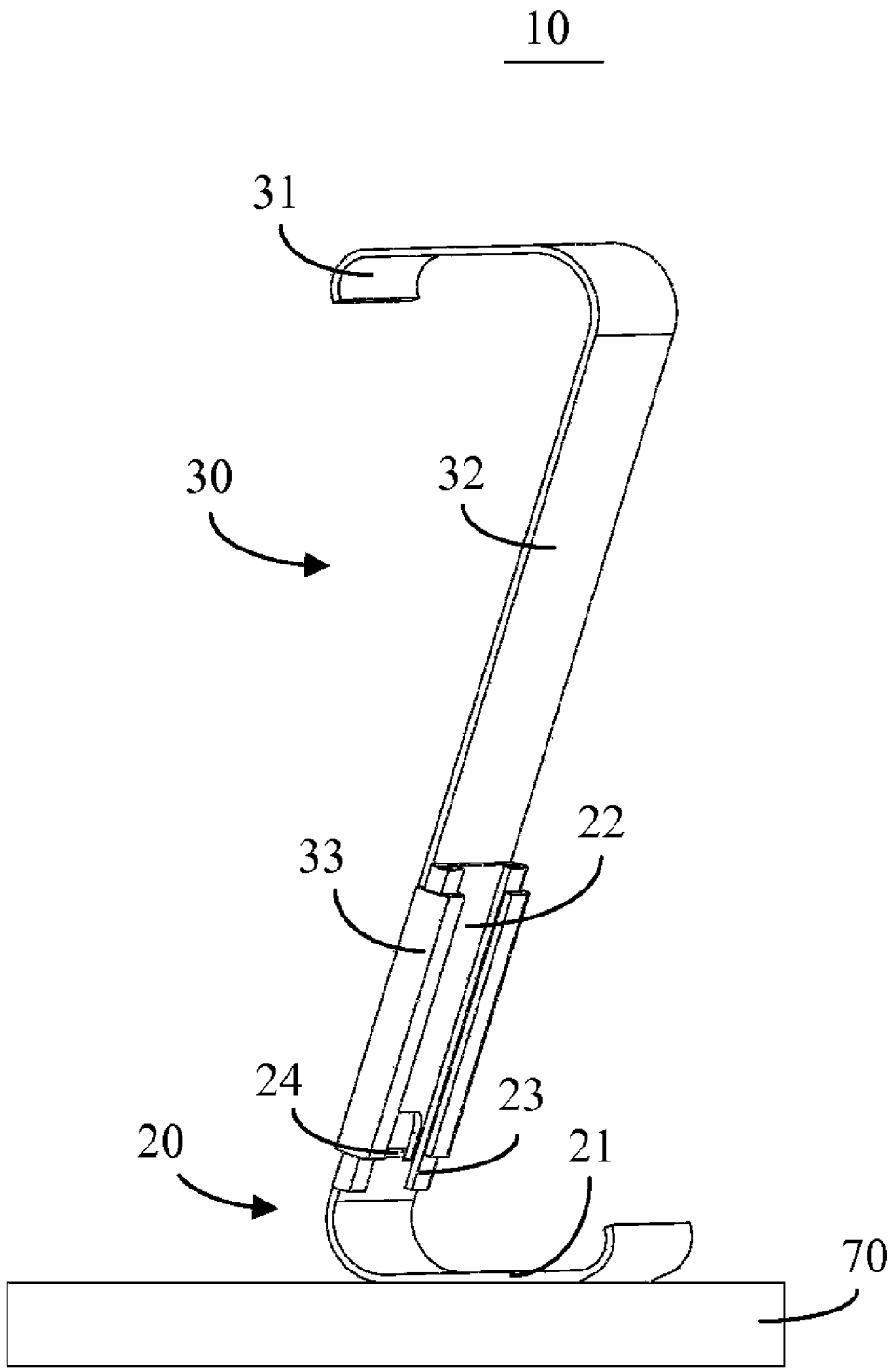
FIG. 1 is a schematic, isometric view of an elastic contact according to an exemplary embodiment, wherein the elastic contact is mounted on a circuit board.
Figure 2:
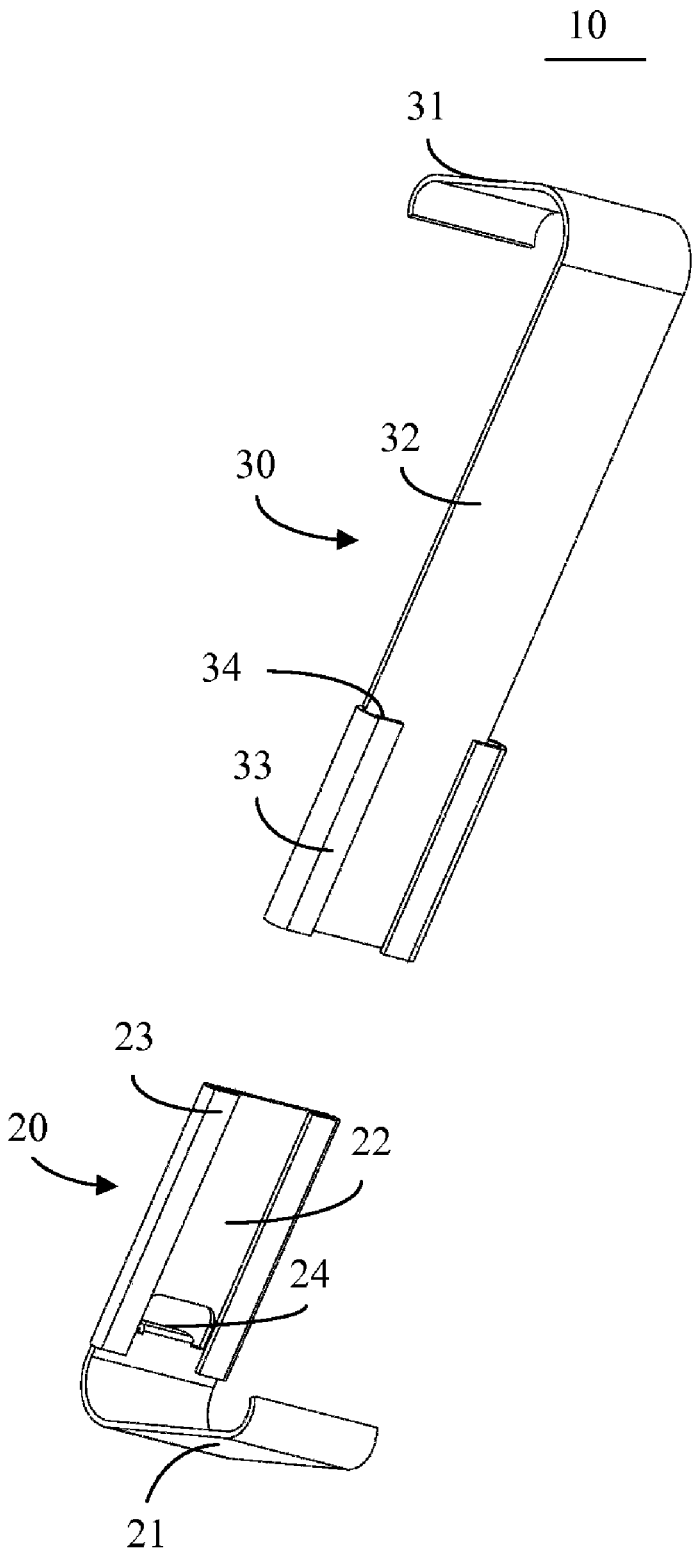
FIG. 2 is an exploded view of the elastic contact of FIG. 1.

Referring to FIG. 1, an elastic contact 10 according to an exemplary embodiment is disclosed. The elastic contact 10 includes a first elastic piece 20 and a second elastic piece 30. The first elastic piece 20 and the second elastic piece 30 are L-shaped. The first elastic piece 20 includes a base 21 and a first connection part 22. The base 21 is configured for being soldered to a circuit board 40. The first connection part 22 extends upwardly from an end of the base 21. The second elastic piece 30 includes a contact part 31 and a second connection part 32. The contact part 31 is configured for resiliently pressing against an electronic element (not shown). The second connection part 32 extends downwardly from an end of the contact part 31. Referring also to FIG. 2, two sidewalls 33 of the second connection part 32 bend to form grooves 34 for receiving the first connection part 22. In another exemplary embodiment, the grooves 34 can be formed in the first connection part 22 and be configured for receiving the second connection part 32. After assembly, two sidewalls 23 of the first connection part 22 bend as well so that the sidewalls 23, 33 resiliently press against each other. A limiting means 24 protrudes from the first connection part 22 for limiting sliding range of the second elastic piece 30. In another exemplary embodiment, the limiting means 24 can be formed on the second connection part 32.

Figure 3:
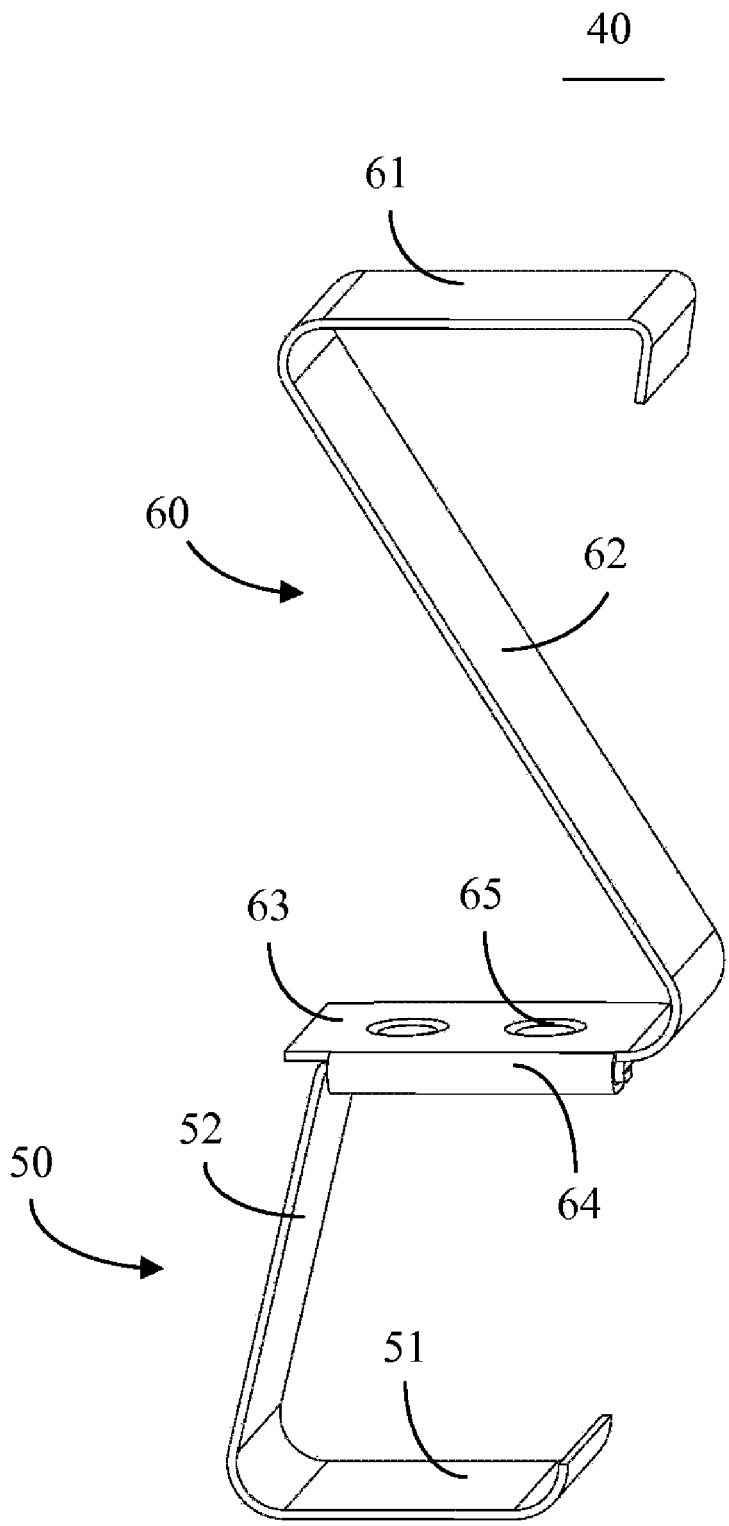
FIG. 3 is a schematic, isometric view of an elastic contact according to another exemplary embodiment.
Figure 4:
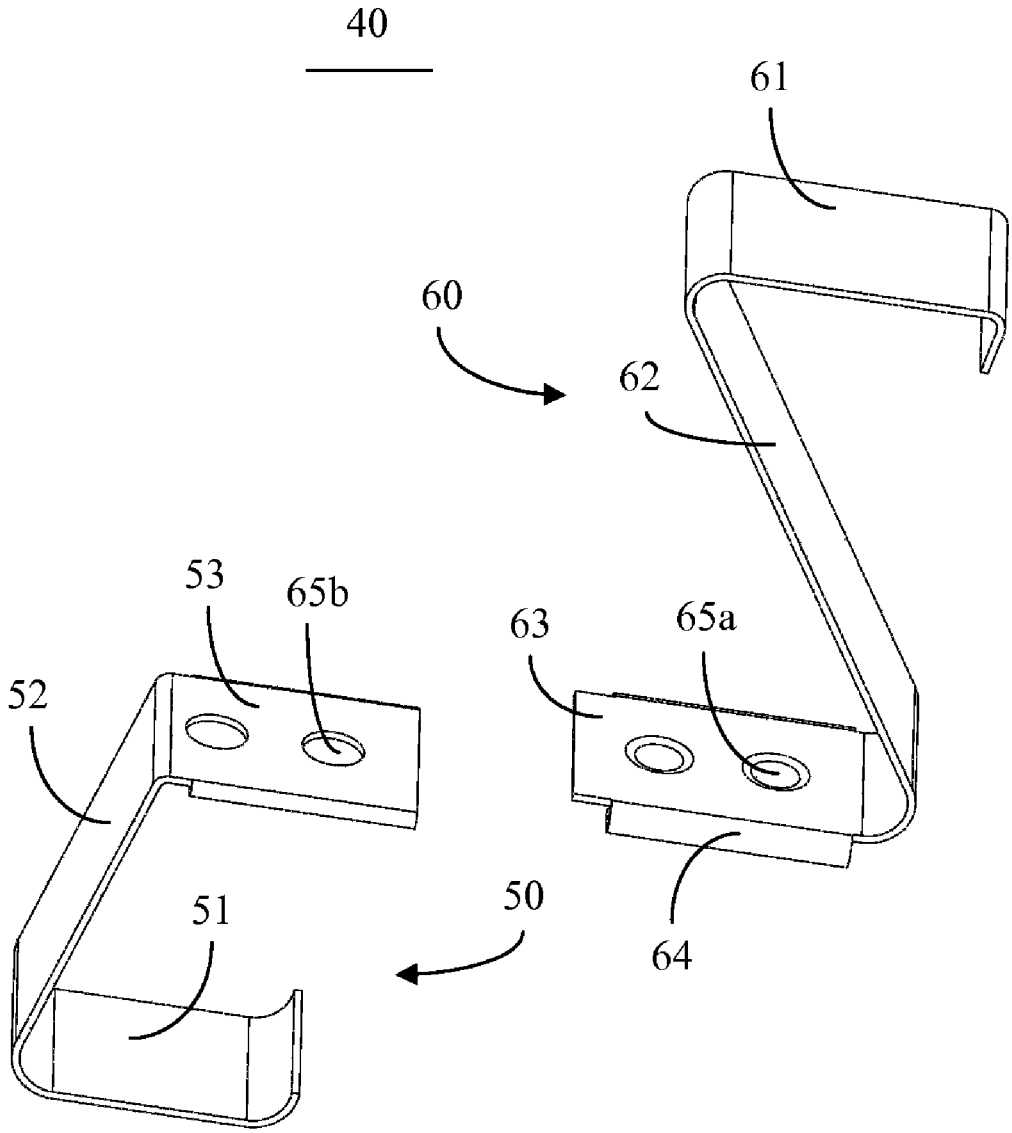
FIG. 4 is an exploded view of the elastic contact of FIG. 3.

Referring to FIGS. 3 and 4, an elastic contact 40 according to a second exemplary embodiment is disclosed. The elastic contact 40 includes a first elastic piece 50 and a second elastic piece 60. The first elastic piece 50 is U-shaped, and includes a base 51, a first bend part 52, and a first connection part 53. The second elastic piece 60 is Z-shaped, and includes a contact part 61, a second bend part 62, and a second connection part 63. Two sidewalls 64 of the second connection part 63 bend to form grooves (not shown) for receiving the first connection part 53. The elastic contact 40 further includes a limiting means 65. The limiting means 65 includes bumps 65*a* and concaves 65*b* respectively formed on the connection parts 53, 63. The bumps 65*a* and the concaves 65*b* engage each other, when the elastic pieces 50, 60 are assembled together thus preventing the elastic pieces 50, 60 from sliding relative to each other.

Moreover, it is to be understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An elastic contact comprising:

a first elastic piece comprising:

a base configured for being soldered to a circuit board; and a connection part extending from the base; and a second elastic piece comprising:

a contact part configured for resiliently pressing against an element;

a connection part connecting the contact part, wherein two sidewalls of one of the connection part bend to form grooves for receiving the other connection part; and limiting means are formed on either of the connection parts for limiting sliding range of the elastic pieces relative to each other.

2. The elastic contact of claim 1, wherein the connection part received in the grooves comprises two bended sidewalls, sidewalls of the two connection parts resiliently press against each other.

3. The elastic contact of claim 1, wherein the first elastic piece and the second elastic piece are L-shaped.

4. The elastic contact of claim 1, wherein the first elastic piece is U-shaped, and the second elastic piece is Z-shaped.

5. The elastic contact of claim 4, further comprising bend parts between the connection parts and the base or the contact part.

6. The elastic contact of claim 3, wherein the limiting means protrudes from the connection part of the first elastic piece.

7. The elastic contact of claim 4, wherein the limiting means includes engaged bumps and concaves.

* * * * *